United States Patent [19]

Gannaway

[11] Patent Number: 4,470,772

[45] Date of Patent: Sep. 11, 1984

[54] DIRECT SUCTION RADIAL COMPRESSOR

[75] Inventor: Edwin L. Gannaway, Adrian, Mich.

[73] Assignee: Tecumseh Products Company, Tecumseh, Mich.

[21] Appl. No.: 380,219

[22] Filed: May 20, 1982

[51] Int. Cl.[3] ..... F04B 39/02; F04B 35/04

[52] U.S. Cl. ..... 417/368; 417/372; 417/419; 417/902

[58] Field of Search ..... 417/366, 367, 368, 372, 417/415, 419, 902, 371, 369, 370

[56] References Cited

U.S. PATENT DOCUMENTS

| | | | |
|---|---|---|---|
| 905,973 | 12/1909 | Zeitlin . | |
| 1,882,220 | 10/1932 | Kercher . | |
| 1,888,860 | 11/1932 | Kercher . | |
| 2,000,874 | 5/1935 | Babb . | |
| 2,228,364 | 1/1941 | Philipp | 417/902 |
| 2,772,047 | 11/1956 | Sonnberger . | |
| 2,959,068 | 11/1960 | Doeg | 417/372 |
| 3,015,222 | 1/1962 | Wellborn et al. | 417/366 |
| 3,081,935 | 3/1963 | Geisenhaver . | |
| 3,104,051 | 9/1963 | Henning . | |
| 3,176,914 | 4/1965 | Rinehart | 417/372 |
| 3,187,996 | 6/1965 | Roelsgaard . | |
| 3,387,774 | 6/1968 | Gannaway . | |
| 3,396,907 | 8/1968 | Valbjorn . | |
| 3,563,677 | 2/1971 | Retan | 417/415 |
| 4,061,444 | 12/1977 | Dirk . | |
| 4,147,479 | 4/1979 | Morse | 417/902 X |

FOREIGN PATENT DOCUMENTS

| | | | |
|---|---|---|---|
| 2079860 | 1/1982 | United Kingdom | 417/415 |

*Primary Examiner*—Carlton R. Croyle
*Assistant Examiner*—Peter M. Cuomo
*Attorney, Agent, or Firm*—Jeffers, Albert L.; Douglas L. Miller

[57] ABSTRACT

A direct suction radial compressor having a crankcase therein dividing the compressor into an upper chamber and a lower chamber sealed one from the other, and suction inlet tubing extending through the top portion of the upper chamber for delivering refrigerant to the compressor. A suction chamber is disposed in the crankcase and sealed from the upper chamber and in communication with the suction inlet tubing, and a plurality of radially disposed cylinders are disposed in the crankcase. Positioned between the suction inlet and the cylinders is a centrifuging assembly that separates liquid refrigerant and oil from gaseous refrigerant, and returns the liquids through a unique network of passageways to an oil sump in the lower chamber. The centrifuging assembly is constructed so that the liquid refrigerant and oil are collected in a chamber having a pressure greater than the pressure in the lower chamber, thereby creating a pressure differential between the liquid containing chamber and oil sump in the lower chamber to force the collected liquids through a plurality of passageways communicating between the liquid collecting chamber and the lower chamber. The gaseous refrigerant is then delivered to a four cylinder scotch-yoke arrangement for compression and discharge to an external refrigerant cooler for cooling the compressed gas. The cooled gaseous refrigerant is then delivered to the upper chamber for cooling cylinder heads and ultimate discharge from the compressor. An oil pump assembly in the bottom of the lower chamber pumps the collected oil out of the compressor and through an oil cooler to cool the oil. The cooled oil is then returned to the oil pump assembly for delivery throughout the compressor to lubricate and cool components therein.

35 Claims, 5 Drawing Figures

DIRECT SUCTION RADIAL COMPRESSOR

BACKGROUND OF THE INVENTION

1. Field of the Invention

This invention pertains to a refrigeration compressor, and more particularly to a direct suction radial compressor wherein incoming refrigerant is fed directly through the compressor housing to a centrifuging assembly which separates the liquid refrigerant and oil from the gaseous refrigerant, which is then delivered to cylinders to be compressed.

2. Description of the Prior Art

In a typical refrigeration compressor, incoming refrigerant is drawn into the compressor housing to be ultimately compressed and then subsequently discharged from the compressor for further use in the refrigeration process. During the period of time the refrigerant is within the compressor housing, several undesirable effects occur. Upon being admitted into the compressor housing, the refrigerant is heated by the heads and motor causing the entrained oil within the refrigerant to be delivered to the sump in the bottom of the compressor.

One undesirable effect apparent from the above heating of the suction gas is the increased work output required of the motor to drive the piston-cylinder arrangement. The work required from the motor to drive the piston-cylinder arrangement to compress the refrigerant is directly proportional to the pressure differential and the volume of the gas in the cylinders. The refrigeration effect is directly proportional to the mass rate of the refrigerant being compressed. For a given cylinder volume, the mass rate will be diminished by any increase in the suction gas temperature. Therefore, a consequence of allowing the refrigerant to be superheated within the compressor housing is less efficient operation of the compressor.

Another undesirable result from allowing the refrigerant to be superheated within the compressor housing is the raising of the temperature of the oil entrained within the refrigerant. Because the refrigerant enters the cylinders at a higher temperature, upon being compressed, the refrigerant has a discharge temperature much higher than if it entered the cylinders at a lower temperature. This higher refrigerant discharge temperature increases the temperature of the lubricating oil, thereby reducing the lubricating properties of the oil and causing premature failure of bearings, wrist pins and the like.

Another type of refrigerant compressor which is commonly utilized is a rotary compressor in which the refrigerant is fed directly into the cylinder. Since this type of refrigeration compressor does not initially draw the refrigerant into the compressor housing to separate the oil and cool the motor, an alternate method must be used to accomplish these requirements. That method comprises discharging the compressed high pressure refrigerant from the cylinder to the housing so that expansion of the refrigerant may occur to separate the oil and cool the motor. This method of oil separation and motor cooling is undesirable in heat pump applications where compression ratios frequently reach excessive levels. High compression ratios result in very high discharge temperatures which reduce motor cooling and generate oil temperatures that reduce lubricity. Under some operating conditions, excessive quantities of refrigerant in high pressure oil reduce lubricity with resulting bearing failures.

SUMMARY OF THE INVENTION

The present invention eliminates the undesirable features and disadvantages of the above prior art refrigeration compressors by providing a direct suction radial compressor that utilizes a centrifuge assembly to separate liquid refrigerant and oil from the incoming gaseous refrigerant, which thereafter is delivered directly to the cylinders to be compressed, thereby preventing the existence in the compressor housing of excessive temperatures which reduce the lubricating properties of the oil.

Rather than separate the liquid refrigerant and oil by allowing the incoming refrigerant to become superheated within the compressor housing, the direct suction radial compressor of the present invention provides a suction chamber within the crankcase, which has a plurality of cylinders radially disposed therein, and which is in communication with the suction inlet tubing. The suction chamber is sealed from the interior of the compressor housing, and has a centrifuging assembly positioned therein between the suction inlet tubing and the cylinders for separating entrained liquid refrigerant and oil from the incoming gaseous refrigerant.

The centrifuging assembly comprises an impeller positioned in front of the suction inlet tubing and which imparts a centrifugal force to the refrigerant to cause the heavier liquid refrigerant and oil to move radially outwardly. The liquid refrigerant and oil impacts the wall of a separation chamber located beneath the impeller and which extends radially outwardly from the impeller periphery. The liquid refrigerant and oil collects in the bottom of the separation chamber and is returned to the sump in the bottom of the compressor housing by a network of passages communicating between the separation chamber and the sump. Although a majority of the gaseous refrigerant passes directly through the impeller and into a yoke cavity for subsequent compression by the cylinders, a portion of gaseous refrigerant follows the flow of the liquid refrigerant and oil. Ths small portion of gaseous refrigerant returns to the yoke cavity through pressure equalization vents just above the motor which is located above the oil sump.

By utilizing this unique combination of centrifuging assembly within a direct suction radial compressor, the need to allow the refrigerant to enter the compressor housing to separate liquid refrigerant and oil is eliminated. Furthermore, there is no increase in required work output of the motor and loss of compressor efficiency caused by the refrigerant entering the cylinders at a higher temperature, and, since the gaseous refrigerant is not utilized to cool the motor, the discharge temperature of the compressed gaseous refrigerant exiting the cylinders is substantially lower, thereby preserving the lubricating properties of the oil and preventing the deterioration of bearings and the like. Since the discharge temperature is lower than the discharge temperatures of those compressors which utilize gas expansion to cool the motor and separate oil from the refrigerant, the direct suction radial compressor of the present invention operates at an efficiency greater than the above-mentioned compressors.

In contrast to the prior art rotary compressors wherein refrigerant is received directly into the cylinders to be compressed and then discharged into the compressor housing to separate the oil and cool the motor, thereby necessitating the compressor housing to be made of a strong, heavy-duty material, the compressor of the present invention is divided into an upper chamber and a lower chamber, which are sealed from each other by the crankcase. The high pressure refrigerant compressed by the cylinders is discharged only into the upper chamber so that, while the upper chamber does contain high pressure refrigerant thereby necessitating it to be made of a strong, thick steel, the lower chamber is maintained at suction inlet pressure and may therefore be made of thinner steel, thereby minimizing weight and cost.

In order to properly cool the motor, an oil cooling device is provided externally of the housing to cool the oil pumped therethrough by an oil pump assembly mounted in the sump in the bottom of the compressor housing. After being cooled by the oil cooling device, the oil returns to the oil pump assembly for recirculation through the motor and bearings. Because of the cooling efficiency of the externally provided oil cooling device, and the low pressure environment in which the motor operates, the motor and bearings run cooler and more efficiently than the motors of prior art compressors, and motor protection devices can be more reliably applied within the cooler environment.

Broadly stated, the present invention provides a direct suction radial compressor comprising a hermetically sealed housing having suction inlet tubing extending therethrough and a crankcase mounted therein, which has a plurality of radially disposed cylinders therein. Disposed in the crankcase, and sealed from the interior of the housing, is a suction chamber communicating with the suction inlet tubing and the cylinders, and a centrifuging assembly positioned in the suction chamber between the suction inlet tubing and the cylinders to separate liquid refrigerant and oil from the incoming gaseous refrigerant. A network of passages is provided to deliver the collected liquid refrigerant and oil to the sump in the bottom of the compressor housing by utilizing gravity flow and a pressure differential created by the centrifuging assembly between the oil collecting area and the compressor lower chamber.

It is an object of the present invention to provide a direct suction radial compressor which separates liquid refrigerant and oil from the incoming gaseous refrigerant by means of a centrifuging assembly, rather than by vaporizing the refrigerant within the compressor housing.

Another object of the present invention is to provide a direct suction radial compressor which delivers incoming gaseous refrigerant directly into the cylinders, thereby avoiding an increase in temperature of the refrigerant within the housing and the accompanying reduction of lubricating properties of the oil and deterioration of bearings and the like.

A further object of the present invention is to provide a direct suction radial compressor which separates liquid refrigerant and oil from the incoming gaseous refrigerant prior to compression, and a separate oil cooler circuit for cooling the motor and bearings to preserve motor and bearing life under the most severe operating conditions.

Yet another object of this invention is to reduce heat transfer from the high temperature compressor heads to the suction gas, thereby increasing the compressor efficiency.

BRIEF DESCRIPTION OF THE DRAWINGS

The above mentioned and other features and objects of this invention, and the manner of attaining them, will become more apparent and the invention itself will be better understood by reference to the following description of an embodiment of the invention taken in conjunction with the accompanying drawings, wherein.

DESCRIPTION OF A PREFERRED EMBODIMENT

Figure 1:
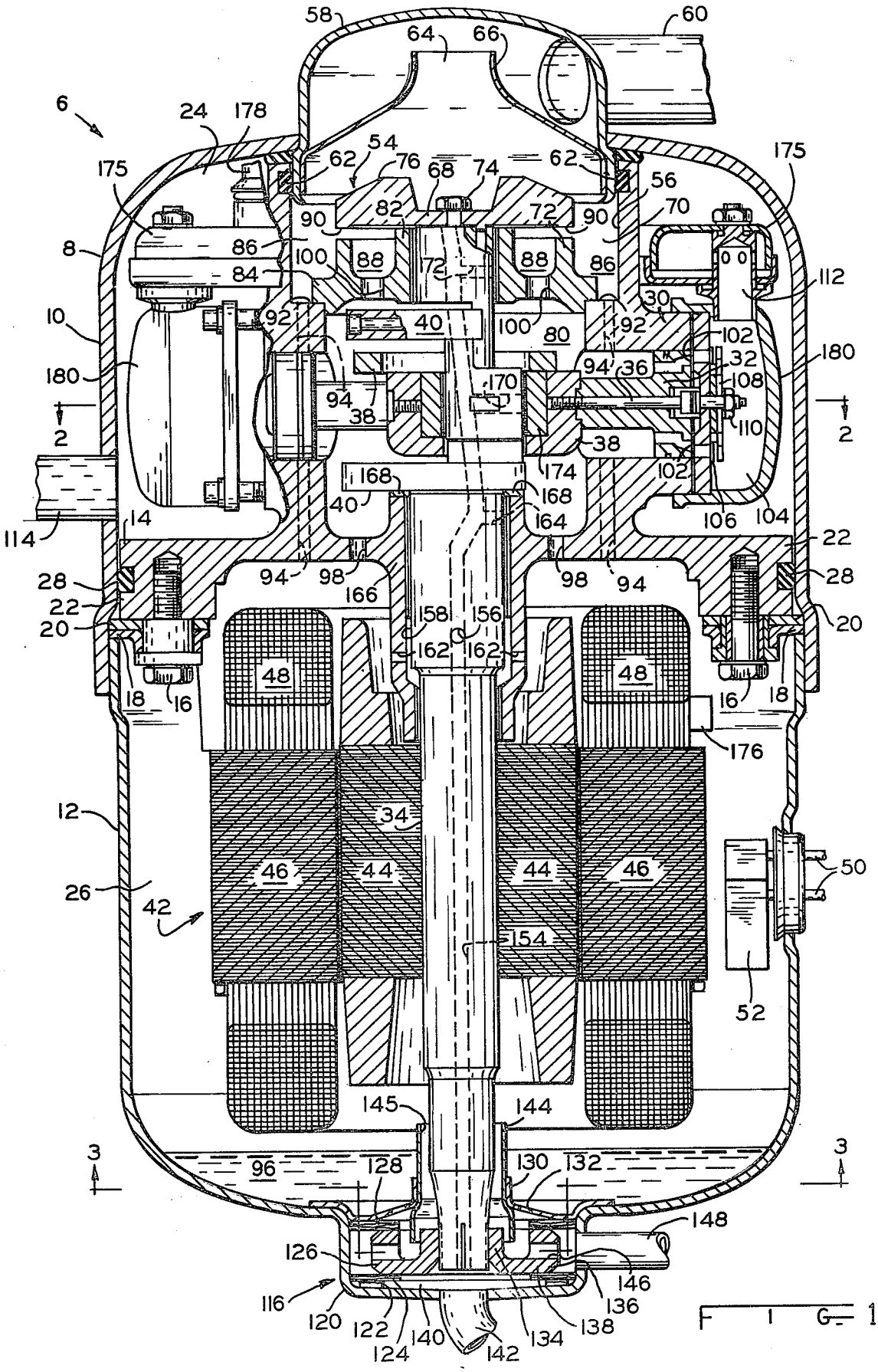
FIG. 1 is a sectional view through the longitudinal axis of a preferred embodiment of the present invention.

Referring to the drawings, and in particular to FIG. 1, direct suction radial compressor 6 of the present invention is illustrated. The exterior of compressor 6 comprises compressor housing 8 having upper housing 10, lower housing 12, and crankcase 14 rigidly mounted therein by screws 16 threadedly received through lower housing flange 18, upper gasket 20, and crankcase supports 22. As depicted, crankcase 14 divides compressor housing 8 into upper housing chamber 24 and lower housing chamber 26, which are sealed from each other. The seal between chambers 24, 26 is provided by the connections between lower housing flange 18 and gasket 20 and between gasket 20 and crankcase supports 22, and O-ring 28 recessed between crankcase supports 22 and upper housing 10.

Symmetrically and radially disposed in the upper portion of crankcase 14 in upper housing chamber 24 are four cylinders 30 having slidably received therein, respectively, four pistons 32, which are operably connected to crankshaft 34 by a scotch-yoke mechanism. Each piston 32 is connected by a threaded stud 36 to a yoke 38, which moves piston 32 within cylinder 30 upon rotation of crankshaft 34. Because of the rigid connection between crankcase 14 and compressor housing 8, it is important to minimize any vibrations therein. The scotch-yoke arrangement of cylinders allows such minimization of vibrations by permitting the pistons to be dynamically balanced by counterweights 40. A more detailed description of the structure and operation of a scotch-yoke radial compressor is found in U.S. Pat. No. 4,273,519, which is incorporated by reference herein. Crankshaft 34 is rotated by motor 42 having rotor 44, stator 46, and windings 48, and which receives its electrical power through terminals 50 in terminal assembly 52.

Continuing to refer to FIG. 1, centrifuging assembly 54 of direct suction radial compressor 6 will be described. Cylindrical wall 56 of crankcase 14 is securely connected to the top portion of upper housing chamber 24 to divide and seal upper housing chamber 24 from the interior spaces of crankcase 14. Suction inlet cover 58 having suction inlet 60 communicating therewith is disposed through upper housing 10 and within cylindrical wall 56. O-ring 62 is recessed within cylindrical wall 56 between cylindrical wall 56 and suction inlet cover 58 in order to maintain the fluid-tight connection between cylindrical wall 56 and upper housing 10, thereby also sealing suction chamber 64 from upper housing chamber 24. Mounted within suction inlet cover 58 and communicating with suction chamber 64 is muffler 66, which directs the incoming refrigerant to centrifuging assembly 54. Centrifuging assembly 54 generally comprises centrifuge 68, cylindrical wall 56, separation chamber 70 and barrier wall 72.

Figure 4:
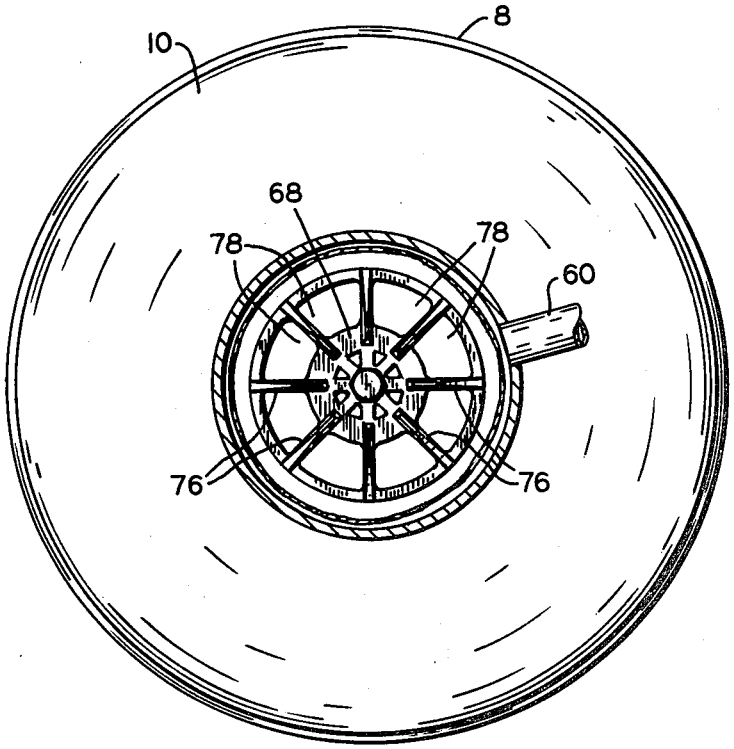
FIG. 4 is a broken away top plan view of a preferred embodiment of the present invention.

Centrifuge 68 is connected to the top end of crankshaft 34 by screw 74 and has a plurality of vanes 76 thereon with a plurality of openings 78 therebetween (FIG. 4). Most of the incoming refrigerant directed to centrifuging assembly 54 is gaseous and most of that gaseous refrigerant will pass through openings 78, while a small portion of gaseous refrigerant and liquid oil and refrigerant will be acted upon by the centrifuging assembly 54 as explained below. It should be noted that centrifuging assembly 54 is positioned between suction chamber 64 and yoke cavity 80, which communicates with cylinders 30.

Separation chamber 70, which like suction chamber 64 is sealed from upper chamber 24, is located partially radially, outwardly from centrifuge 68 and partially below centrifuge 68. Separation chamber 70 is generally defined by cylindrical wall 56, centrifuge 68, top bearing 82, and cage bearing 84. Separation chamber 70 is divided into first separation chamber 86 and second separation chamber 88 by barrier wall 72 upstanding from cage bearing 84 and spaced apart from the peripheral undersurface of centrifuge 68 to define barrier passage 90 through which first separation chamber 86 and second separation chamber 88 communicate. Important to note here is the relative positions of first separation chamber 86 and second separation chamber 88 relative to centrifuge 68, i.e., first separation chamber 86 is positioned radially outwardly of centrifuge 68, while second separation chamber 88 is radially, inwardly of first separation chamber 86 and below centrifuge 68.

Figure 2:
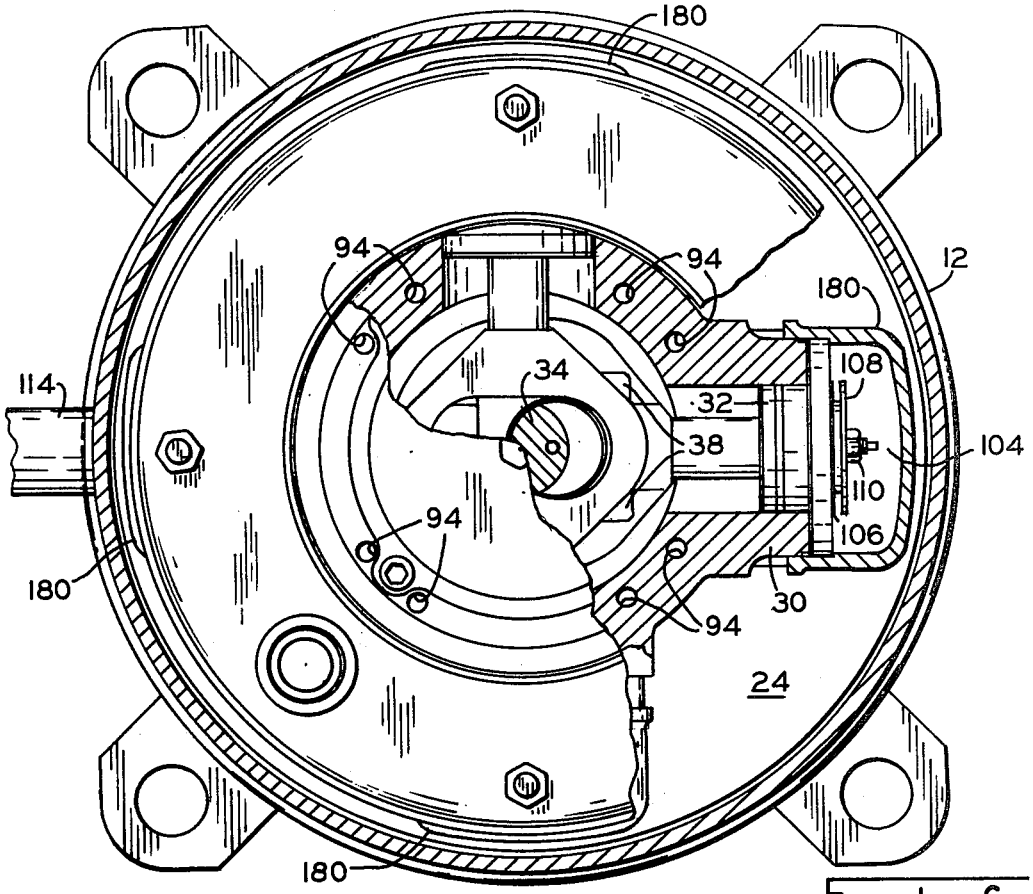
FIG. 2 is a sectional view of FIG. 1 along line 2—2 and looking in the direction of the arrows.

Formed by cylindrical wall 56, barrier wall 72, and cage bearing 84 is oil well 92 for collecting liquid refrigerant and oil separated by centrifuge 68. Liquid refrigerant and oil collected in oil well 92 are returned to oil sump 96 in lower chamber 26 by eight oil return passageways 94 communicating between first separation chamber 86 and lower chamber 26. Referring to FIG. 2, it can be seen that the oil return passageways 94 are arranged so that two oil return passageways 94 are disposed between each piston-cylinder arrangement. To assist the return of liquid refrigerant and oil to oil sump 96, a plurality of vents 98 are provided which communicate between lower chamber 26 and yoke cavity 80, which in turn communicates with second separation chamber 88 by passages 100. Oil return passageways 94 are also conveniently disposed within crankcase 14 so that the returning cool liquid refrigerant and oil flow over rotor 44, stator 46 and windings 48 to assist in cooling motor 42, and are preferably long and narrow to minimize noise transmissions to lower housing 12.

Referring now to FIGS. 1 and 2, it can be seen that the piston-cylinder arrangement is somewhat conventional with pistons 32 having ports 102 disposed therein to allow communication between yoke cavity 80 and head cavity 104. Each piston 32 has disposed over its ports 102 a ring valve-wave washer combination 106, which is maintained thereon by valve retainer 108 received on threaded stud 36 and secured thereto by locknut 110. Compressed refrigerant discharged into head cavity 104 is further directed into discharge muffler 175 and to discharge gas cooler 177 via a connector outlet 178 and line 179. The cool discharge gas is then passed through housing chamber 24 via line 182 where it cools the heads 180 and mufflers 175 and ultimately leaves the compressor 6 through outlet 114.

Figure 3:
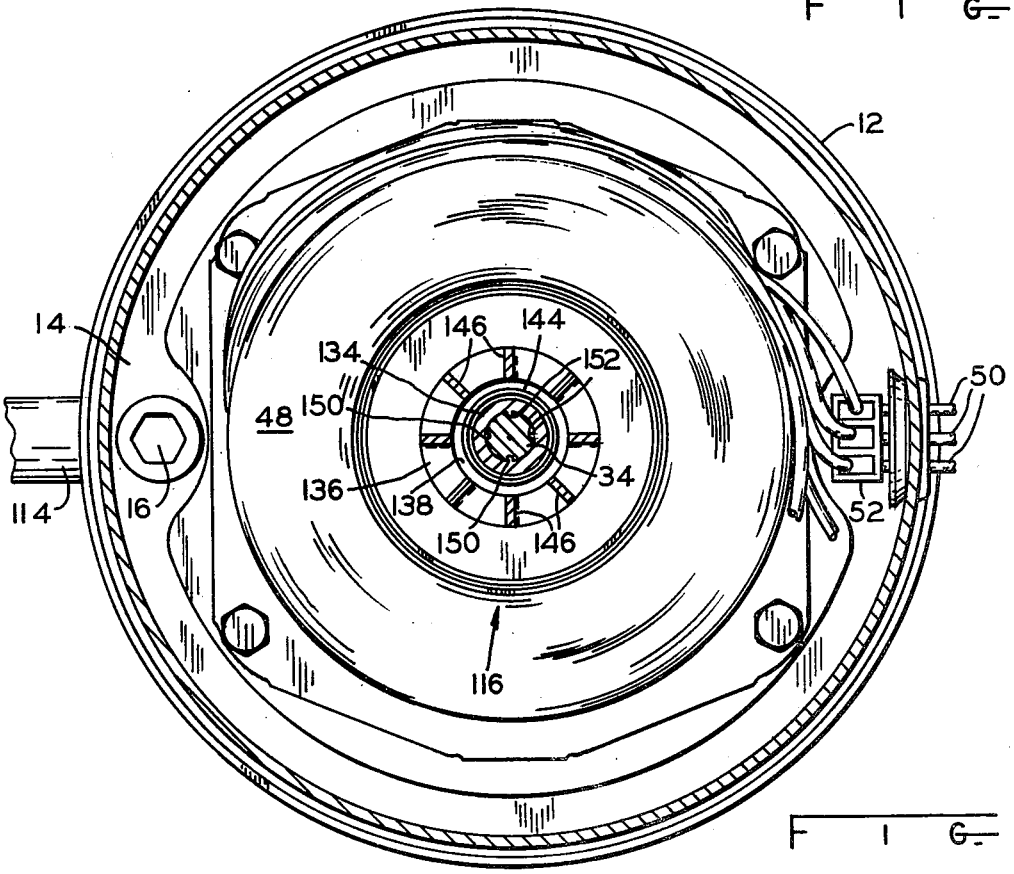
FIG. 3 is a sectional view of FIG. 1 along line 3—3 and looking in the direction of the arrows.
Figure 5:
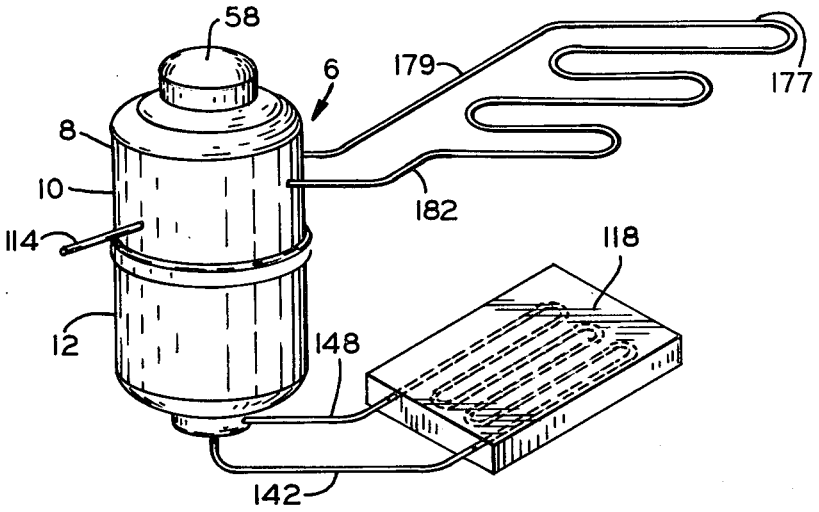
FIG. 5 is a schematic of the cooling features of the present invention.

FIGS. 1, 3 and 5 should be referred to for a description of oil pump assembly 116 and oil heat exchanger 118, which is external of compressor housing 8. In the bottom of lower housing 12 is a cup-shaped central portion 120 containing therein circular spring support 122 secured to the bottom of central portion 120 and having an opening centrally disposed therethrough; a circular bearing plate 124 preferably made of a phenolic resin positioned on top of circular support 122 and also having an opening centrally disposed therethrough; impeller 126 placed on top of bearing plate 124; and a second bearing plate 128 positioned on top of impeller 126 and likewise having an opening centrally disposed therethrough and preferably made of a phenolic resin. These elements within cup-shaped central portion 120 are maintained therein by skirt 130 which is secured to the inner surface of lower housing chamber 126 and in abutment with the top surface of bearing plate 128. Skirt 130 also has a plurality of skirt openings 132 disposed therethrough to allow the oil in oil sump 96 to communicate with oil pump assembly 116.

Impeller 126 is shaped such that it has an inner cylindrical wall 134, an outer cylindrical wall 136, and a bottom wall 138 disposed therebetween. Defined and sealed from lower housing chamber 26 by the bottom of cup-shaped central portion 120, support 122, bearing plate 124, bottom wall 138, and the end of crankshaft 34, which is connected to impeller 126, is oil inlet chamber 140 communicating with oil heat exchanger 118 through oil inlet tube 142.

During operation of oil pump assembly 116, cavitation is prevented by vent 145 and vortex spoiler 144 which is disposed through and connected to an opening centrally located in skirt 130. Vortex spoiler 144 is of such a length that its top portion is above the level of the oil in oil pump 96 and its bottom portion is positioned between impeller inner cylindrical wall 134 and outer cylindrical wall 136. A plurality of impeller openings 146 are disposed through impeller outer cylindrical wall 136 to permit impeller 126 to pump lubricant received through skirt openings 132 through oil outlet tubing 148 communicating with oil heat exchanger 118.

Impeller 126 is connected to the bottom end of crankshaft 34 by a plurality of vertically disposed slots 150 on the interior surface of impeller inner cylindrical wall 134 and the like plurality of splines 152 vertically disposed on the exterior surface portion of the bottom end of crankshaft 34, which engage slots 150 upon crankshaft 34 being lowered in compressor housing 8 and through impeller 126. This allows oil pump assembly 116 to be preassembled in compressor housing 8, thereby simplifying the production of direct suction radial compressor 6.

In operation, incoming refrigerant is delivered through suction inlet 60 to suction chamber 64 and then to centrifuging assembly 54 by muffler 66. The incoming refrigerant is composed of gaseous and liquid refrigerant and liquid oil at a pressure between approximately 60–80 psi and a temperature between approximately 60°–70° F. As earlier mentioned, the majority of the gaseous refrigerant passes directly through openings 78 in centrifuge 68 to yoke cavity 80, while the liquid refrigerant and oil and a small portion of gaseous refrigerant are thrown against cylindrical outer wall 56 by the centrifugal force imparted thereto by rotating centrifuge 68. Upon contacting cylindrical outer wall 56, the liquid refrigerant and oil are collected in oil well 92 and returned to oil sump 96 through oil return passageways 94. The small portion of gaseous refrigerant thrown into first separation chamber 86 and liquid refrigerant which subsequently vaporizes passes through barrier passage 90 into second separation chamber 88 and subsequently through passages 100 to yoke cavity 80.

Upon entering yoke cavity 80, the gaseous refrigerant is drawn through ports 102 in pistons 32 into cylinders 30 upon inward travel of pistons 32. Thereafter, on the outward stroke of pistons 32, the gaseous refrigerant is compressed within cylinders 30 and discharged through ring valve-wave washer assembly 106 into head cavity 104. Thereafter, the gas is discharged through discharge tube 112 to muffler 175 and outlet 178 for cooling in cooler 177. The cooled gas is then delivered to chamber 24 via line 182. The discharged gaseous refrigerant in upper housing chamber 24 is at a pressure between approximately 200–400 psi and at a temperature of approximately 150° F. Because of the high pressure within upper housing chamber 24, upper housing 10 is made of a strong, heavy-duty metal capable of withstanding such pressures.

The novelty of operating centrifuging assembly 54 between direct suction inlet chamber 64 and cylinders 30 aside, a further unique feature of direct suction radial compressor 6 of the present invention is the method of assisting the return of the collected gaseous and liquid refrigerant and oil to oil sump 96 in lower housing 12. Because the amount of liquid accumulating in oil well 92 may be substantial, gravity flow of the liquids to oil sump 96 may not be sufficient to evacuate first separation chamber 86 of the liquids, thereby raising the possibility of the liquids passing through bearing passage 90 and eventually entering cylinders 30. To prevent this possibility from occurring, a pressure differential is created between first separation chamber 86 and lower chamber 26. Selecting an average incoming suction pressure of approximately 75 psi, for example, the small portion of gaseous refrigerant at this pressure is urged into first separation chamber 86 by centrifuge 68. Because of the substantial centrifugal force with which the gaseous refrigerant is urged into first separation chamber 86, the pressure within first separation chamber 86 is slightly greater than that in suction chamber 64, for example, 76 psi. The gas forced into first chamber 86 thereafter exits through barrier passage 90 into second separation chamber 88, however, because of the narrowness of barrier passage 90 the flow of gas therethrough is restricted to cause a lower pressure in second separation chamber 88, for example, 74 psi. Since lower housing chamber 26 is in communication with second separation chamber 88 through vents 98, yoke cavity 80 and passages 100, it also is at a pressure of approximately 74 psi. Because lower chamber 26 is at a lower pressure than first separation chamber 86, liquids collected in oil well 92 are assisted in their gravity flow through oil return passageways 94 by the pressure differential between first separation chamber 86 and lower chamber 26. Furthermore, depending upon the size of the compressor and the amount of liquid refrigerant and oil mixed with the gaseous refrigerant, the pressure differential created between first separation chamber 86 and lower housing chamber 26 may be varied by altering the diameters and lengths of oil return passageways 94, the restrictive clearance of barrier passage 90, and the diameters and lengths of vents 98. These three items may be varied collectively or individually to create the required pressure differential to assist the return of liquid oil and refrigerant to an oil sump.

Because lower housing chamber 26 is at suction inlet pressure between approximately 60–80 psi, lower housing 12 may be made of a lightweight metal, thereby producing a less expensive, lightweight direct suction radial compressor 6.

The oil returned to oil sump 96 passes through skirt openings 132 and between impeller outer cylindrical wall 136 and inner cylindrical wall 134, where it is centrifugally forced by impeller 126 through impeller openings 146 and oil outlet tubing 148 for cooling by oil heat exchanger 118. Thereafter, the cooled oil is delivered through oil inlet tubing 142 into inlet chamber 140 and then drawn upwardly through crankshaft 34 for lubricating various components within compressor housing 8. The oil is drawn by the rotational action of crankshaft 34 upwardly through main oil groove 154, where a portion of the oil is distributed through openings 156 into annulus 158 for lubricating main bearing 160. This portion of the oil thereafter passes through holes 162 to lubricate and cool motor 42. The remaining oil then travels further upwardly so that a portion of the remaining oil is distributed through hole 164 to lubricate main bearing 166. Thrust bearing 168 is disposed between main bearing 166 and counterweight 40 to prevent oil from entering yoke cavity 80 and possibly entering cylinders 30. From hole 164, the remaining oil again further travels upwardly and is distributed through hole 170 and hole 172 to lubricate slide block 174 and top bearing 82, respectively. Prevention of oil entering yoke cavity 80 is provided by eliminating oil grooves between the above mentioned bearings and crankshaft 34 and force-feeding oil through the particular oil holes to a respective bearing.

In the environment of lower housing chamber 26, motor 42 runs at a temperature between approximately 170°–180° F., and to prevent any overheating of motor 42, a temperature sensing device 176 is connected to motor 42. Should the temperature of motor 42 rise to an unacceptable level, temperature sensor 176 will shut down motor 42. Because the motor chamber is separate from the compressor chamber 24 containing the hot discharge gases, a thermal sensor can effectively be used to sense over-current conditions.

While this invention has been described as having a specific embodiment, it will be understood that it is capable of further modifications. This application is therefore intended to cover any variations, uses or adaptations of the invention following the general principles thereof, and including such departures from the present disclosure as come within known or customary practice in the art to which this invention pertains and fall within the limits of the appended claims.

I claim:

1. A direct suction radial compressor comprising:

a hermetically sealed housing having suction inlet tubing extending therethrough, said housing having an interior space, a crankcase being mounted within said housing and having a plurality of radially disposed cylinders therein, said crankcase dividing said housing interior space into an upper half and a lower half sealed one from the other, said housing upper half having said suction inlet tubing extending therethrough and containing said cylinders therein, a suction chamber in said housing upper half and being connected to said crankcase and communicating with said cylinders, said suction chamber being sealed from said housing upper half, said suction inlet tubing being connected directly to said suction chamber, centrifuge means being connected to a top portion of a crankshaft disposed in said crankcase and positioned in said suction chamber between said suction inlet tubing and said cylinders for separating refrigerant and oil from gaseous refrigerant, and passageway means for conducting the separated liquid refrigerant and oil to a sump in said housing lower half.

2. The compressor of claim 1 wherein said centrifuging means comprises an impeller having a plurality of vanes thereon and a plurality of openings therethrough, and a separation chamber being radially, outwardly disposed from and partially subjacent said impeller and sealed from said housing upper half, said separation chamber having an outer wall to collect liquid refrigerant and oil separated by said impeller and an oil well in its bottom portion to receive the separated refrigerant and oil from said outer wall.

3. The compressor of claim 2 further including a barrier upstanding from said separation chamber bottom portion and subjacently spaced from said impeller to define a barrier passage therebetween, said barrier further dividing said separation chamber into a first separation chamber containing said oil well and a second separation chamber disposed radially inwardly of said first chamber, thereby preventing liquid refrigerant and oil from entering said cylinders.

4. A direct suction radial compressor comprising:

a hermetically sealed housing having mounted therein a crankcase dividing said housing into an upper and a lower chamber sealed one from the other, said upper chamber adapted to receive high pressure discharged gaseous refrigerant, said crankcase having a plurality of radially oriented cylinders therein, a crankshaft rotatably received in said crankcase and having a plurality of pistons radially connected thereto, said pistons being disposed in respective said cylinders to compress gaseous refrigerant received therein to high pressures, a suction chamber being disposed in a top portion of said crankcase and sealed from said housing upper chamber by said crankcase, suction inlet tubing extending through said housing and into said suction chamber to deliver refrigerant and oil under a first pressure to said suction chamber, centrifuging means being positioned in said suction chamber and connected to said crankshaft, said centrifuging means disposed between said suction inlet tubing and said cylinders to separate liquid refrigerant and oil from gaseous refrigerant, and a network of passages disposed in said crankcase for delivering separated liquid refrigerant and oil to a sump in said housing lower chamber.

5. The compressor of claim 4 wherein said centrifuging means comprises an impeller body having a plurality of vanes thereon for separating liquid refrigerant and oil from gaseous refrigerant received from said suction inlet tubing, and a separation chamber in said crankcase being positioned partially subjacent to and radially outwardly from said impeller body and sealed from said upper chamber, said separation chamber having a barrier upstanding therefrom and spaced apart from said impeller body to define a barrier passage, said barrier dividing said separation chamber into an oil collecting chamber for the separated liquid refrigerant and oil and a gas chamber radially inwardly of said oil collecting chamber, said gas chamber being in communication with said oil collecting chamber and said cylinders.

6. The compressor of claim 5 wherein said network of passages includes a plurality of passageways in communication with said oil collecting chamber and said housing lower chamber to allow the separated liquid refrigerant and oil to flow into said sump.

7. The compressor of claim 4 further including first heat exchanger means externally of said compressor for cooling and filtering the oil, and pump means in said sump for circulating the oil through said first heat exchanger means.

8. The compressor of claim 4 further including second heat exchanger means externally of said compressor for cooling discharged compressed gaseous refrigerant from said cylinders, said second heat exchanger means then delivering the cooled compressed gaseous refrigerant into said upper chamber for the cooling of cylinder heads therein.

9. In combination with a direct suction radial compressor including a hermetically sealed housing having suction inlet tubing extending therethrough and a crankcase mounted therein, said crankcase dividing said housing into an upper and a lower chamber sealed one from the other and having a plurality of cylinders radially disposed therein, a crankshaft rotatably disposed in said crankcase, a suction chamber disposed in said crankcase and sealed from said upper chamber, said suction chamber being in communication with said cylinders and said suction inlet tubing, centrifuging means positioned in said suction chamber for separating liquid refrigerant and oil from gaseous refrigerant, and a passageway communicating between said centrifuging means and said housing lower chamber to allow separated liquid refrigerant and oil to flow to a sump in said lower chamber, an oil pump assembly comprising:

impeller means connected to a lower portion of said crankshaft and disposed in the lubricant in said sump, heat exchanger means externally disposed from said housing and in communication with said impeller means for lowering the temperature of the lubricant pumped by said impeller means therethrough, an inlet chamber in and sealed from said lower chamber and in communication with said heat exchanger means for receiving cooled lubricant therefrom, and means in said inlet chamber for circulating the cooled lubricant throughout said sealed upper and lower chambers.

10. The assembly of claim 9 wherein said crankshaft lower portion has a plurality of vertically disposed splines thereon and said impeller means has a plurality of vertically disposed slots therein to receive respective said splines, thereby engaging said crankshaft to said impeller means.

11. The assembly of claim 10 further including a vortex spoiler circumferentially disposed about and spaced apart from said crankshaft lower portion and forming a vent therebetween, said vortex spoiler extending axially of said crankshaft lower portion and being partially submerged within the lubricant in said sump.

12. A direct suction radial compressor comprising:

a hermetically sealed housing having mounted therein a crankcase dividing said housing into an upper and a lower chamber sealed one from the other, said upper chamber adapted to receive cooled compressed gaseous refrigerant, said crankcase having a plurality of radially oriented cylinders therein, a crankshaft rotatably received in said crankcase and having a plurality of pistons radially connected thereto, said pistons being disposed in respective said cylinders to compress gaseous refrigerant received therein to high pressures, a suction chamber being disposed in a top portion of said crankcase and sealed from said housing upper chamber by said crankcase, suction inlet tubing extending through said housing and into said suction chamber to deliver refrigerant and oil under a first pressure to said suction chamber, means in said suction chamber and between said suction inlet tubing and cylinders for separating liquid refrigerant and oil from gaseous refrigerant, and means for delivering separated liquid refrigerant and oil to a sump in said lower chamber.

13. The compressor of claim 12 wherein said delivering means comprises a plurality of passageways in said crankcase and communicating between said suction chamber and said lower chamber.

14. The compressor of claim 12 further including first heat exchanger means externally of said compressor for cooling discharged compressed gaseous refrigerant received from said cylinders, said first heat exchanger means then delivering the cooled compressed gaseous refrigerant into said upper chamber for the cooling of cylinder heads therein.

15. The compressor of claim 14 further including second heat exchanger means externally of said compressor for cooling and filtering the oil, and pump means in said sump for circulating oil through said second heat exchanger means.

16. The compressor of claim 15 wherein said housing has an inner surface and said crankcase has a peripheral portion extending outwardly therefrom and in close proximity to a portion of said inner surface to divide said housing into said upper and lower chambers, and further including a first sealing member disposed between said crankcase peripheral portion and said inner surface portion to seal said upper chamber from said lower chamber.

17. The compressor of claim 16 wherein said suction chamber is sealed from said upper chamber by a second sealing member disposed between said crankcase top portion and a portion of said housing inner surface adjacent thereto.

18. The compressor of claim 15 wherein said separating means comprises an impeller body connected to said crankshaft and having a plurality of vanes thereon for separating liquid refrigerant and oil from gaseous refrigerant received from said suction inlet tubing, and a separation chamber in said crankcase being positioned partially subjacent to and radially outwardly from said impeller body and sealed from said upper chamber, said separation chamber having a barrier upstanding therefrom and spaced apart from said impeller body to define a barrier passage, said barrier dividing said separation chamber into an oil collecting chamber for the separated liquid refrigerant and oil and a gas chamber radially inwardly of said oil collecting chamber, said gas chamber being in communication with said oil collecting chamber and said cylinders.

19. The compressor of claim 18 wherein said delivering means comprises a plurality of passageways in said crankcase and in communication with said oil collecting chamber and said housing lower chamber to allow the separated liquid refrigerant and oil to flow into said sump.

20. A direct suction radial compressor comprising:

a hermetically sealed housing having suction inlet tubing extending therethrough, said housing having an interior space, a crankcase being mounted within said housing and having a plurality of radially disposed cylinders therein, said crankcase dividing said housing interior space into an upper half and a lower half sealed one from the other, said housing upper half having said suction inlet tubing extending therethrough and containing said cylinders therein, a suction chamber in said housing upper half and being connected to said crankcase and communicating with said cylinders, said suction chamber being sealed from said housing upper half, said suction inlet tubing being connected directly to said suction chamber, centrifuge means being connected to a top portion of a crankshaft disposed in said crankcase and positioned in said suction chamber between said suction inlet tubing and said cylinders, said centrifuge means comprising an impeller having a plurality of vanes thereon and a plurality of openings therethrough, and a separation chamber radially outwardly disposed from and partially subjacent said impeller and sealed from said housing upper half, said separation chamber having an outer wall to collect liquid refrigerant and oil separated by said impeller and an oil well in its bottom portion to receive the separated refrigerant and oil from said outer wall, a barrier member upstanding from said separation chamber bottom portion and subjacently spaced from said impeller to define a barrier passage therebetween, said barrier member further dividing said separation chamber into a first separation chamber containing said oil well and a second separation chamber disposed radially inwardly of said first separation chamber, thereby preventing liquid refrigerant and oil from entering said cylinders, and passageway means for conducting the separated liquid refrigerant and oil to a sump in said housing lower half, said passageway means comprising a plurality of passageways communicating between said oil well in said first separation chamber and said housing lower half, and vent means communicating between said second separation chamber and said housing lower half, whereby liquid refrigerant and oil are urged downwardly through said passageways into said sump by a pressure differential existing between an increased pressure created by said impeller in said first separation chamber and a decreased pressure created by said barrier member in said second separation chamber.

21. The compressor of claim 20 further including oil cooling means externally disposed from said housing and in communication with said sump for lowering the temperature of the oil.

22. The compressor of claim 21 wherein said cylinders have a four cylinder scotch-yoke arrangement.

23. The compressor of claim 22 further including a motor being drivingly connected to a bottom portion of said crankshaft located in said housing lower half and having temperature sensing means attached thereto for preventing overheating of said motor.

24. A direct suction radial compressor comprising:

a hermetically sealed housing having mounted therein a crankcase dividing said housing into an upper and lower chamber sealed one from the other, said upper chamber adapted to receive high pressure discharged gaseous refrigerant, said crankcase having a plurality of radially oriented cylinders therein, a crankshaft rotatably received in said crankcase and having a plurality of pistons radially connected thereto, said pistons being disposed in respective said cylinders to compress gaseous refrigerant received therein to high pressures, a suction chamber being disposed in a top portion of said crankcase and sealed from said housing upper chamber by said crankcase, suction inlet tubing extending through said housing and into said suction chamber to deliver refrigerant and oil under a first pressure to said suction chamber, centrifuging means being positioned in said suction chamber and connected to said crankshaft, said centrifuging means being disposed between said suction inlet tubing and said cylinders and comprising an impeller body having a plurality of vanes thereon for separating liquid refrigerant and oil from gaseous refrigerant received from said suction inlet tubing, a separation chamber in said crankcase being positioned partially subjacent to and radially outwardly from said impeller body and sealed from said upper chamber, said separation chamber having a barrier upstanding therefrom and spaced apart from said impeller body to define a barrier passage, said barrier dividing said separation chamber into an oil collecting chamber for the separated liquid refrigerant and oil and a gas chamber radially inwardly of said oil collecting chamber, said gas chamber being in communication with said oil collecting chamber and said cylinders, and a network of passages disposed in said crankcase and comprising a plurality of passageways in communication with said oil collecting chamber and said housing lower chamber to allow the separated liquid refrigerant and oil to flow into said sump, said impeller body being rotatable to centrifugally deliver liquid refrigerant and oil and a portion of the gaseous refrigerant to said oil collecting chamber at a second pressure greater than said first pressure, said barrier passage having a narrow vertical dimension relative to said oil collecting chamber and said gas chamber, thereby causing the gaseous refrigerant in said gas chamber to be at a third pressure less than said second pressure, said network of passages further comprising a plurality of vent passages in communication with said gas chamber and said housing lower chamber to substantially maintain said lower chamber at said third pressure, whereby separated liquid refrigerant and oil in said oil collecting chamber is urged downwardly through said plurality of passageways by the pressure differential between said oil collecting chamber and said housing lower chamber.

25. The compressor of claim 24 further including first heat exchanger means externally of said compressor for cooling and filtering the oil, and pump means located in said sump for circulating the oil through said first heat exchanger means.

26. The compressor of claim 25 further including an outlet disposed through said upper chamber to direct the compressed gaseous refrigerant received from said cylinders therefrom.

27. The compressor of claim 26 further including means connected to said crankshaft in said housing lower chamber for rotating said crankshaft, and temperature sensing means connected to said rotating means for preventing overheating of said rotating means.

28. The compressor of claim 27 wherein said cylinders are arranged in a four cylinder scotch-yoke fashion.

29. In combination with a direct suction radial compressor including a hermetically sealed housing having suction inlet tubing extending therethrough and a crankcase mounted therein, said crankcase dividing said housing into an upper chamber and a lower chamber sealed one from the other and having a plurality of cylinders radially disposed therein, a suction chamber disposed in said crankcase and sealed from said upper chamber, said suction chamber being in communication with said cylinders and said suction inlet tubing, centrifuging means positioned in said suction chamber for separating liquid refrigerant and oil from gaseous refrigerant, and a passageway communicating between said centrifuging means and said housing lower chamber to allow separated liquid refrigerant and oil to flow to a sump in said lower chamber, an oil pump assembly comprising:

a crankshaft rotatably disposed in said crankcase and having a lower portion with a plurality of vertically disposed splines thereon, an impeller means having a plurality of vertically disposed slots received on said splines to engage said crankshaft to said impeller means, said impeller means being disposed in the lubricant in said sump, heat exchanger means externally disposed from said housing and in communication with said impeller means for lowering the temperature of the lubricant pump by said impeller means therethrough, an inlet chamber in and sealed from said lower chamber and in communication with said heat exchanger means for receiving cooled lubricant therefrom, means in said inlet chamber for circulating the cooled lubricant throughout said sealed upper and lower chambers, a vortex spoiler circumferentially disposed about and spaced apart from said crankshaft lower portion and forming a vent therebetween, said vortex spoiler extending axially of said crankshaft lower portion and being partially submerged within the lubricant in said sump, and a skirt member connected to said vortex spoiler and extending radially outwardly therefrom, said skirt member having a portion thereof submerged in the lubricant in said sump and in surface contact with said impeller means and a plurality of openings therein to provide fluid communication between said sump and said impeller means.

30. The compressor of claim 29 further including a first bearing plate disposed between said skirt member portion and said impeller means, and a second bearing plate disposed between said impeller means and said inlet chamber.

31. The compressor of claim 30 wherein said first and said second bearing plates are made of a phenolic resin.

32. A direct suction radial compressor comprising:

a hermetically sealed housing having mounted therein a crankcase dividing said housing into an upper chamber and a lower chamber sealed one from the other, said upper chamber adapted to receive cooled compressed gaseous refrigerant, said crankcase having a plurality of radially oriented cylinders therein, a crankshaft rotatably received in said crankcase and having a plurality of pistons radially connected thereto, said pistons being disposed in respective said cylinders to compress gaseous refrigerant received therein to high pressure, a suction chamber being disposed in a top portion of said crankcase and sealed from said housing upper chamber by said crankcase, suction inlet tubing extending through said housing and into said suction chamber to deliver refrigerant and oil under a first pressure to said suction chamber, means in said suction chamber and between said suction inlet tubing and said cylinders for separating liquid refrigerant and oil from gaseous refrigerant, said separating means comprising an impeller body connected to said crankshaft and having a plurality of vanes thereon for separating liquid refrigerant and oil from gaseous refrigerant received from said suction inlet tubing, and a separation chamber in said crankcase being positioned partially subjacent to and radially outwardly from said impeller body and sealed from said upper chamber, said separation chamber having a barrier upstanding therefrom and spaced apart from said impeller body to define a barrier passage, said barrier dividing said separation chamber into an oil collecting chamber for the separated liquid refrigerant and oil and a gas chamber radially inwardly of said oil collecting chamber, said gas chamber being in communication with said oil collecting chamber and said cylinders, means for delivering separated liquid refrigerant and oil to a sump in said lower chamber, said delivering means comprising a plurality of passageways in said crankcase and in communication with said oil collecting chamber and said housing lower chamber to allow the separated liquid refrigerant and oil to flow into said sump, said impeller body being rotatable to centrifugally deliver liquid refrigerant and oil and a portion of gaseous refrigerant to said oil collecting chamber at a second pressure greater than said first pressure, said barrier passage having a narrow vertical dimension relative to said oil collecting chamber and said gas chamber, thereby causing the gaseous refrigerant in said gas chamber to be at a third pressure less than said second pressure, a plurality of vent passages in communication with said gas chamber and said housing lower chamber to substantially maintain said lower chamber at said third pressure, whereby the separated liquid refrigerant and oil in said oil collecting chamber is urged downwardly through said plurality of passageways by the pressure differential between said oil collecting chamber and said housing lower chamber, a first heat exchanger means externally of said compressor for cooling discharge compressed gaseous refrigerant received from said cylinders, said first heat exchanger means then delivering the cooled compressed gaseous refrigerant into said upper chamber for the cooling of cylinder heads therein, and a second heat exchanger means externally of said compressor for cooling and filtering the oil, and pump means in said sump for circulating oil through said second heat exchanger means.

33. The compressor of claim 32 further including an outlet disposed in said upper chamber to deliver cool compressed gaseous refrigerant therefrom.

34. The compressor of claim 33 further including means connected to said crankshaft in said housing lower chamber for rotating said crankshaft, and temperature sensing means connected to said rotating means for preventing overheating of said rotating means.

35. The compressor of claim 34 wherein said cylinders are arranged in a four cylinder scotch-yoke fashion.

* * * * *